US008015932B2

(12) United States Patent
Eiteneer et al.

(10) Patent No.: US 8,015,932 B2
(45) Date of Patent: Sep. 13, 2011

(54) METHOD AND APPARATUS FOR OPERATING A FUEL FLEXIBLE FURNACE TO REDUCE POLLUTANTS IN EMISSIONS

(75) Inventors: Boris Nikolaevich Eiteneer, Irvine, CA (US); William Randall Seeker, San Clemente, CA (US); Roy Payne, Mission Viejo, CA (US)

(73) Assignee: General Electric Company, Schenectady, NY (US)

( * ) Notice: Subject to any disclaimer, the term of this patent is extended or adjusted under 35 U.S.C. 154(b) by 431 days.

(21) Appl. No.: 11/950,615

(22) Filed: Dec. 5, 2007

(65) Prior Publication Data

US 2009/0078175 A1 Mar. 26, 2009

Related U.S. Application Data

(60) Provisional application No. 60/999,749, filed on Sep. 24, 2007.

(51) Int. Cl.

| | |
|---|---|
| ***F23C 1/10*** | (2006.01) |
| ***F23K 3/02*** | (2006.01) |
| ***F23N 5/02*** | (2006.01) |
| ***F23D 1/00*** | (2006.01) |

(52) U.S. Cl. ..... 110/262; 110/104 R; 110/190; 110/347

(58) Field of Classification Search ..... 110/262, 110/260, 261, 263, 347, 186, 187, 190, 104 R; 431/278, 279, 280, 281, 284
See application file for complete search history.

(56) References Cited

U.S. PATENT DOCUMENTS

| | | | | |
|---|---|---|---|---|
| 4,488,516 | A * | 12/1984 | Bueters et al. | 110/185 |
| 5,121,600 | A * | 6/1992 | Sanders et al. | 110/245 |
| 5,378,083 | A * | 1/1995 | Swanson | 110/346 |
| 5,720,165 | A * | 2/1998 | Rizzie et al. | 110/265 |
| 6,699,029 | B2 * | 3/2004 | Kobayashi et al. | 110/345 |
| 6,726,888 | B2 * | 4/2004 | Lanier et al. | 423/99 |
| 6,863,005 | B2 * | 3/2005 | Lanier et al. | 110/345 |
| 6,973,883 | B1 * | 12/2005 | Annamalai et al. | 110/345 |
| 6,986,311 | B2 * | 1/2006 | Vatsky et al. | 110/262 |
| 7,168,947 | B2 * | 1/2007 | Zamansky et al. | 431/10 |
| 7,544,339 | B2 * | 6/2009 | Lissianski et al. | 110/234 |
| 7,780,437 | B2 * | 8/2010 | Bernero et al. | 431/75 |

* cited by examiner

*Primary Examiner* — Kenneth B Rinehart
*Assistant Examiner* — David J Laux
(74) *Attorney, Agent, or Firm* — Cantor Colburn LLP

(57) ABSTRACT

A fuel flexible furnace, including a main combustion zone, a reburn zone downstream from the main combustion zone, and a delivery system operably coupled to supplies of biomass and coal and configured to deliver the biomass and the coal as ingredients of first and reburn fuels to the main combustion zone and the reburn zone, with each fuel including flexible quantities of the biomass and/or the coal. The flexible quantities are variable with the furnace in an operating condition.

8 Claims, 4 Drawing Sheets

METHOD AND APPARATUS FOR OPERATING A FUEL FLEXIBLE FURNACE TO REDUCE POLLUTANTS IN EMISSIONS

CROSS REFERENCE TO RELATED APPLICATIONS

This non-provisional application claims the benefit of priority of U.S. Provisional Application 60/999,749, which was converted on Oct. 11, 2007 to provisional status from U.S. patent application Ser. No. 11/860,222, filed on Sep. 24, 2007, the contents of both of which are incorporated herein in their entirety.

BACKGROUND OF THE INVENTION

Aspects of the present invention relate to furnace operations and, more particularly, to furnace operations that reduce pollutants in emissions.

As global climate concerns grow, methods and apparatuses for reducing emissions from fossil fuel boilers have been employed. These methods and apparatuses have incorporated fuel staging, biomass co-firing, biomass gasification, biomass reburn and/or combinations thereof into furnace operations to reduce pollutant emissions including NOx, SOx, CO2, Hg, etc.

However, each of the above noted methods includes certain shortcomings that have limited their applicability. These shortcomings include the need to rely on the availability of seasonal fuels, the need to preprocess the fuels, inefficiencies, and high costs. In addition, with respect to the use of biomass alone in co-firing or reburn operations, the shortcomings discussed above are particularly relevant and often result in emissions reductions not achieving their full entitlement.

BRIEF DESCRIPTION OF THE INVENTION

In accordance with an aspect of the invention, a fuel flexible furnace is provided that comprises a main combustion zone, a reburn zone downstream from the main combustion zone, a burnout zone downstream from the reburn zone, and a delivery system operably coupled to supplies of biomass and coal and configured to deliver the biomass and the coal as ingredients of first and reburn fuels to the main combustion zone and the reburn zone, with each fuel including flexible quantities of the biomass and/or the coal. The flexible quantities are variable with the furnace in an operating condition.

In accordance with another aspect of the invention, a fuel flexible furnace of a boiler to reduce pollutant emissions is provided that comprises a main combustion zone, a reburn zone downstream from the main combustion zone, a delivery system operably coupled to supplies of biomass and coal and configured to deliver the biomass and the coal as ingredients of first and reburn fuels to the main combustion zone and the reburn zone, with each fuel including flexible quantities of the biomass and/or the coal, the flexible quantities being variable with the furnace in an operating condition, a burnout zone in which overfire air (OFA) is injected into the burnout zone to mix with emissions of the main combustion zone and the reburn zone to create oxygen rich and fuel lean emissions, an exhaust path, coupled to an outlet of the burnout zone, in which particulate matter is removed from heat transfer surfaces of the furnace, and an exhaust system coupled to the exhaust path through which the emissions are exhausted to an exterior of the boiler. Operations of the exhaust path and the exhaust system are controlled in accordance with the flexible quantities of the biomass and coal in each fuel.

In accordance with another aspect of the invention, a method of operating a fuel flexible furnace is provided that comprises combusting first and reburn fuels in a main combustion zone of the furnace, injecting the first and reburn fuels into a reburn zone of the furnace, which is located downstream from the main combustion zone, and supplying flexible quantities of biomass and/or coal as ingredients of the first and reburn fuels. The flexible quantities are variable during an operating condition of the furnace.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION

Figure 1:
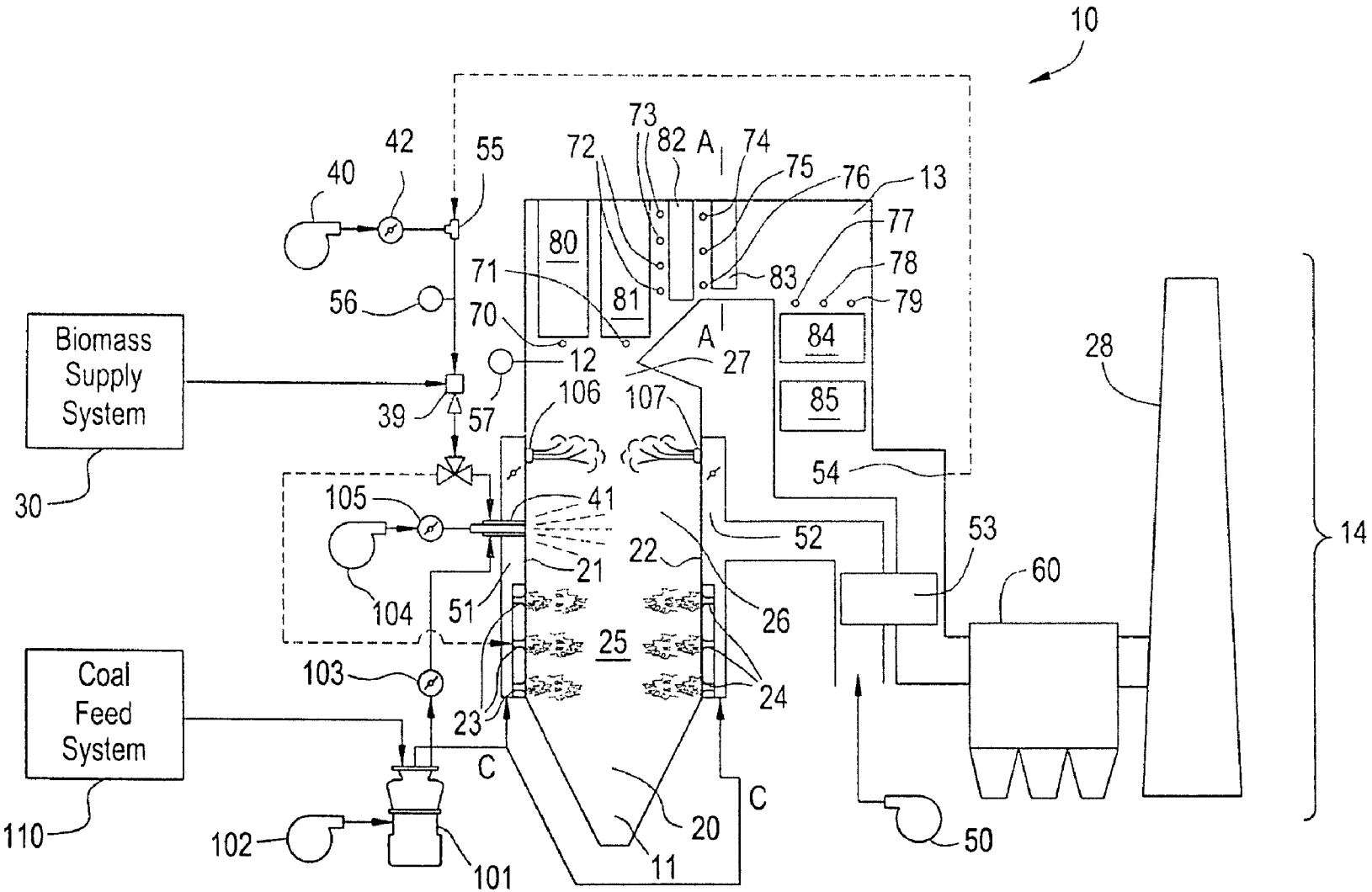
FIG. 1 is a schematic view of a boiler including a fuel flexible furnace according to an embodiment of the invention.

As shown in FIG. 1, a boiler 10 includes a furnace 20 having a furnace bottom 11, an outlet 12, an exhaust path 13 and an exhaust system 14. The outlet 12 is typically narrower than the furnace 20 and is provided to allow emissions generated in the furnace to escape. The exhaust path 13, through which the emissions travel upon exiting through the outlet 12, is coupled to the outlet 12 and extends first in a substantially lateral orientation with respect to the furnace 20 and then in a substantially downward orientation with respect to the furnace 20. Accumulated particulate matter from emissions generated in the furnace 20 is removed from heat transfer surfaces in the exhaust path 13. The exhaust system 14 is coupled to the exhaust path 13 and allows the emissions generated in the furnace 20 to be exhausted to the atmosphere. While the boiler 10 is illustrated as a pulverized coal (PC) opposed wall-fired boiler, embodiments of this invention could be applied to other types of boilers as well. These include front wall-fired boilers, tangentially-fired boilers, and cyclone-fired boilers, etc.

Figure 2:
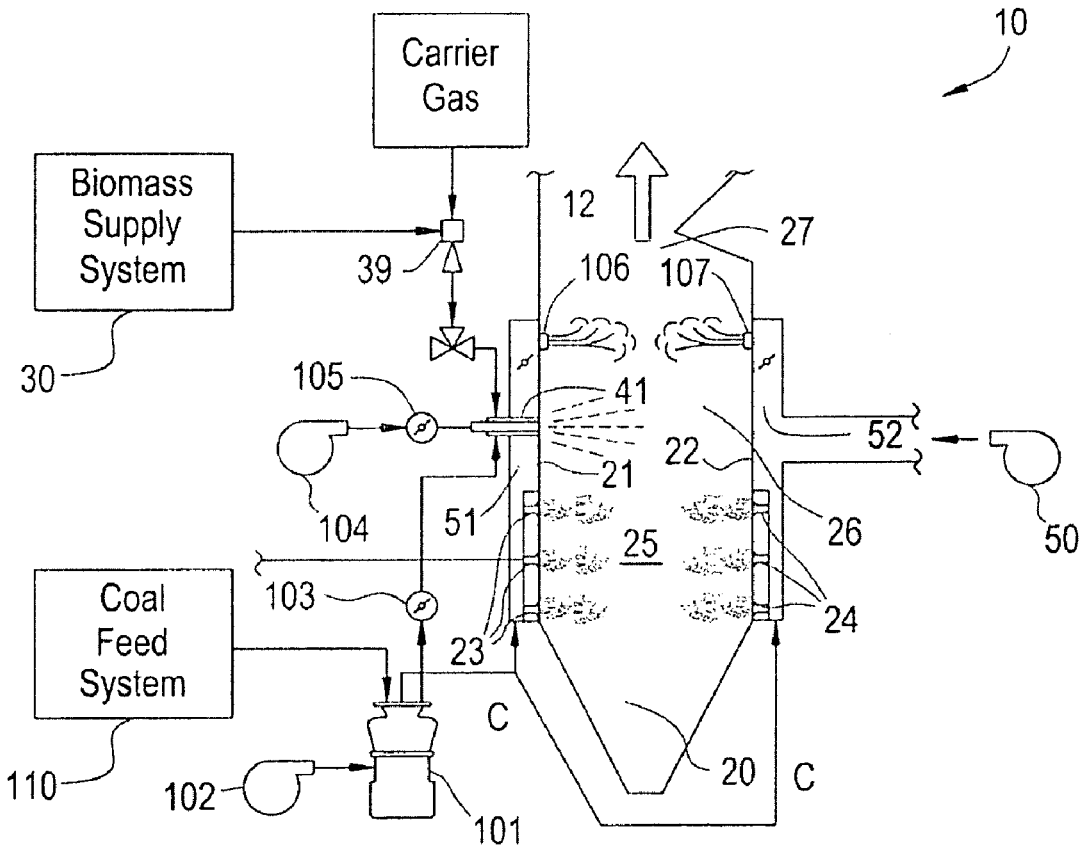
FIG. 2 is a schematic view of a fuel flexible furnace of the boiler of FIG. 1.

With reference to FIGS. 1 and 2, the furnace includes a front wall 21, a back wall 22 and side walls (not shown) that define interior surfaces of the furnace 20, the furnace bottom 11 and the outlet 12. In addition, the front wall 21, the back wall 22 and the side walls define interior surfaces of a main combustion zone 25 and a reburn zone 26 disposed downstream from the main combustion zone 25.

Proximate to the main combustion zone 25, pluralities of first burners 23 are arranged on the front wall 21 with pluralities of second burners 24 similarly arranged on the back wall 22. In an embodiment of the invention, the first and the second burners 23 and 24 are arranged in rows. A first fuel, such as pulverized coal, pulverized coal/petroleum coke mixture, etc., is pneumatically supplied from a mill 101 of a coal feed system 110 of a fuel delivery system, an embodiment of which will be described later with reference to FIG. 3, to the first and second burners 23 and 24 along coal feed lines, C. Combustion air is pumped by fan 50 to the first and second burners 23 and 24 via air manifolds 51 and 52 and the air healer 53, which may heat the pumped air. The first and second burners 23 and 24 fire and combust the first fuel and the air in the main combustion zone 25. As will be described below, additional embodiments exist in which biomass is included in the first fuel.

The firing of the first and second burners 23 and 24 produces emissions, which may include pollutants such as nitrogen oxides (NOx), carbon dioxide ($CO_2$), sulfur oxides (SOx) and mercury (Hg), in the main combustion zone 25. The emissions are transported through the furnace 20, the exhaust path 13 and the exhaust system 14 to be emitted to the atmosphere through the exhaust slack 28 (see FIG. 6).

In accordance with embodiments of the invention, modified combustion processes in the furnace 20 reduce amounts of the pollutants in the emissions. That is, reburn fuel, which may comprise, for example, biomass, coal and/or a combination of flexible quantities of biomass and coal, is injected into reburn zone 26, which is disposed within the furnace 20 and downstream from the main combustion zone, by at least one reburn injector 41. The reburn fuel reacts with and reduces amounts of the pollutants in the emissions of the main combustion zone in accordance with compositional ingredients thereof. That is, the reburn fuel reacts with and reduces nitrogen oxide emissions by converting the nitrogen oxides into molecular nitrogen. Here, the biomass in the reburn fuel is supplied from a biomass supply system 30 of the fuel delivery system, an embodiment of which will be described below with reference to FIG. 4. Since biomass is a $CO_2$-neutral fuel, emissions of $CO_2$ are reduced in direct proportion to the percent of fossil fuel substituted with biomass. When biomass that contains lower amounts of sulfur and mercury compared to original coal fuel is used to provide a portion of the heat input to the boiler, the emissions of SOx and Hg are decreased relative to a coal-only firing mode. Due to the elevated concentrations of alkali and alkali earth compounds in biomass as compared to coal, biomass char produced during biomass oxidation is typically more reactive and often has higher porosity and surface area than char produced by coal oxidation. Higher reactivity and surface area of biomass char results in efficient capture of mercury released during combustion on the biomass char particles and subsequently. Additionally, chlorine content of biomass released during combustion improves mercury oxidation from its elemental form $Hg^0$ to the oxidized form $Hg^{2-}$ that can subsequently be efficiently captured by methods known in field. As a result, of the above processes, utilization of biomass fuel results in decreased amount of mercury released to the atmosphere.

As shown in FIG. 2, the reburn zone 26 is located downstream from the main combustion zone 25 in the furnace 20. A booster air fan 104 and a damper 105 are coupled to the at least one reburn injector 41 to improve mixing of the reburn fuel in the reburn zone 26. While only one reburn injector 41 is shown in FIG. 2, additional reburn injectors 41 may be coupled to the furnace 20 in similar or alternate locations. For example, one or more reburn injectors 41 can be located at the front 21, back 22, and/or side walls of the furnace 20 so as to achieve an efficient mixing of the reburn fuel in the reburn zone 26. In any case, each reburn injector 41 may be supplied with biomass and by separate coal feed lines designated by the arrow extending from mill 101 through damper 103 and toward the reburn injector 41. In addition, each reburn injector 41 may be supplied with a separate damper 105 to control the flow of boost air and the mixing characteristics of the reburn fuel stream injected through each of the reburn injectors 41.

In accordance with embodiments of the invention, an efficient mixing of the reburn fuel with combustion gases that are present in the reburn zone 26 requires a substantially complete penetration of the reburn fuel into the furnace 20. To this end, various constructions of the reburn injector 41 may be employed. In one construction, a composite reburn injector 41, which does not mix coal and biomass particles prior to their injection into the reburn zone 26, injects coal and biomass particles into the reburn zone 26 of the furnace 20 with different trajectories. In another construction, the necessary penetration of the reburn fuel into the reburn zone 26 can be achieved by pre-mixing reburn injectors 41 that are designed to mix coal and biomass fuel particles prior to their injection into the reburn zone 26.

To complete the combustion process, overfire air (OFA) is injected into a burnout zone 27 of the furnace 20, which is located downstream from the reburn zone 26. The OFA is injected through a plurality of OFA injectors 106 and 107. While the OFA injectors 106 and 107 are shown as being level with one another in the furnace 20, in alternate embodiments of the invention, one or more OFA injectors can also be located downstream from the burnout zone 27 in an upper part of the furnace 20. The injection of the OFA creates an oxygen rich and fuel lean exhaust gas that passes through the outlet 12, the exhaust path 13 and the exhaust system 14.

Figure 3:
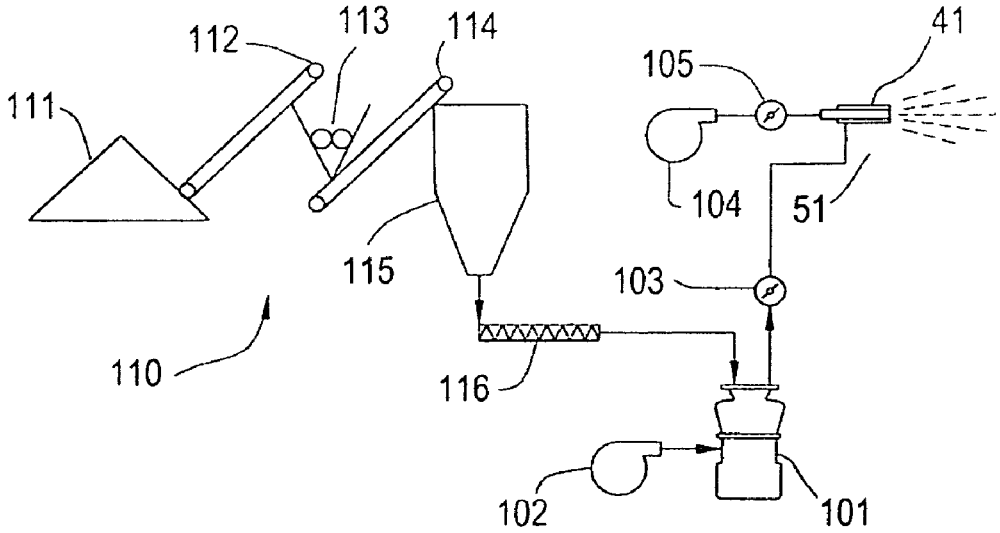
FIG. 3 is a schematic view of a coal feed system in accordance with an embodiment of the invention.

A system for providing the reburn fuel to the reburn zone 26, according to embodiments of the invention, will now be described. With reference to FIG. 3, an exemplary embodiment of the coal feed system 110 supplies mill 101 with coal to be pulverized. An output of the mill 101, which is not provided to the first and second burners 23 and 24 via the coal feed lines, C, is provided to the reburn injector 41, as shown in FIGS. 1 and 2 by the arrow extending from the mill 101 and through the damper 103. Fan 102 supplies air to operate the mill 101 and to transport the pulverized coal through the damper 103 and to the reburn injector 41. The coal feed system 110, according to an embodiment of the invention, may further include the coal pile 111, bell feeders 112 and 114, coal grinder 113, temporary coal storage silo 115, and a feeder 116 to store the coal as necessary and to transport the coal to the mill 101. When the reburn fuel includes the supply of the biomass along with the pulverized coal, the reduction of nitrogen oxide emissions is accompanied by at least a reduction in carbon dioxide emissions as well.

Figure 4:
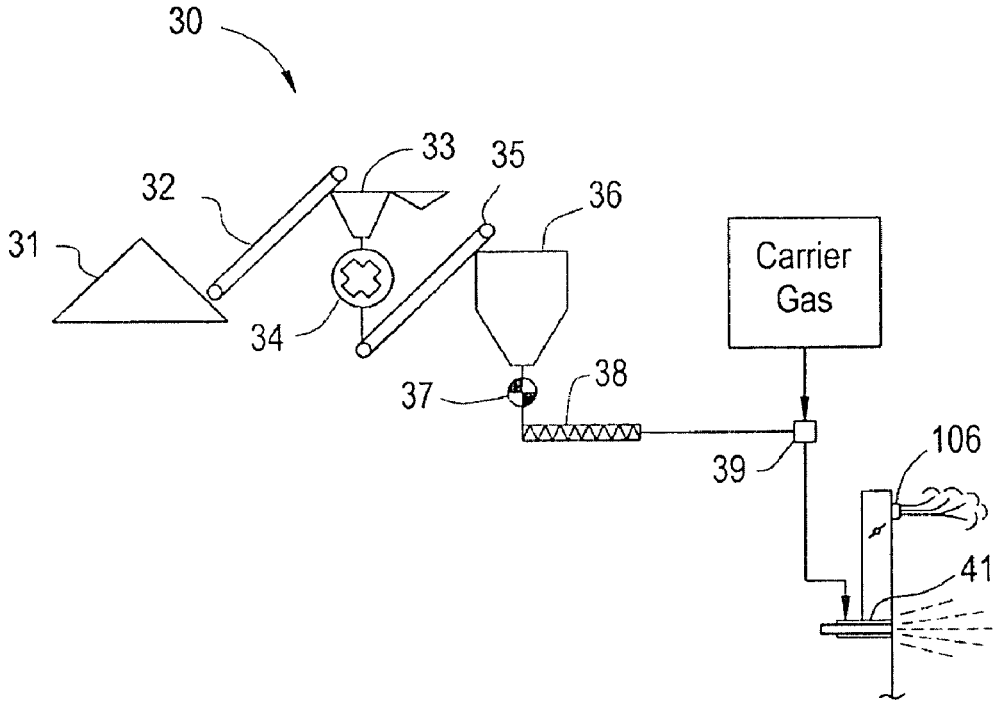
FIG. 4 is a schematic view of a biomass supply system in accordance with an embodiment of the invention.

With reference to FIG. 4, biomass is supplied to the reburn injector 41 by the biomass supply system 30 preferably in particle size ranges of approximately 0.2 to 2 millimeters in lengths and all nested sub-ranges therein. In this manner, the reburn fuel supplies about 20-30% of the total heat input for the furnace 20 but 40-50% of the fuel supply. Consequently, but for advantages provided by embodiments of the present invention, a relatively large amount of biomass may be required.

Here, it is noted that the structure of the biomass supply system is highly dependent upon the nature of the biomass being used. As such, the embodiment shown in FIG. 4 should be considered as only an exemplary biomass supply system 30.

As shown in FIG. 4, biomass may be initially stored in a biomass storage device 31. A screening device 33 screens out very large particles while the size reduction device 34, such as a hammermill, reduces sizes of the screened particles. Transporters 32 and 35 transport the biomass through the biomass supply system 30 and into a hopper 36 for temporary storage.

The hopper 36 is sufficiently sized to provide for a smooth operation of the furnace 20 over a certain period of time. For example, a capacity of the hopper 36 may provide a sufficient amount of biomass to act as fuel for a weeklong operation of the furnace 20 or as fuel for as little as 8 hours of uninterrupted operation of the furnace 20. From the hopper 36, the biomass is conveyed through airlock 37 and a screw conveyor 38 to the eductor 39. The eductor 39 mixes the biomass with a carrier gas and, subsequently, the biomass/carrier gas mixture is pneumatically conveyed to the reburn injector 41.

Figure 5:
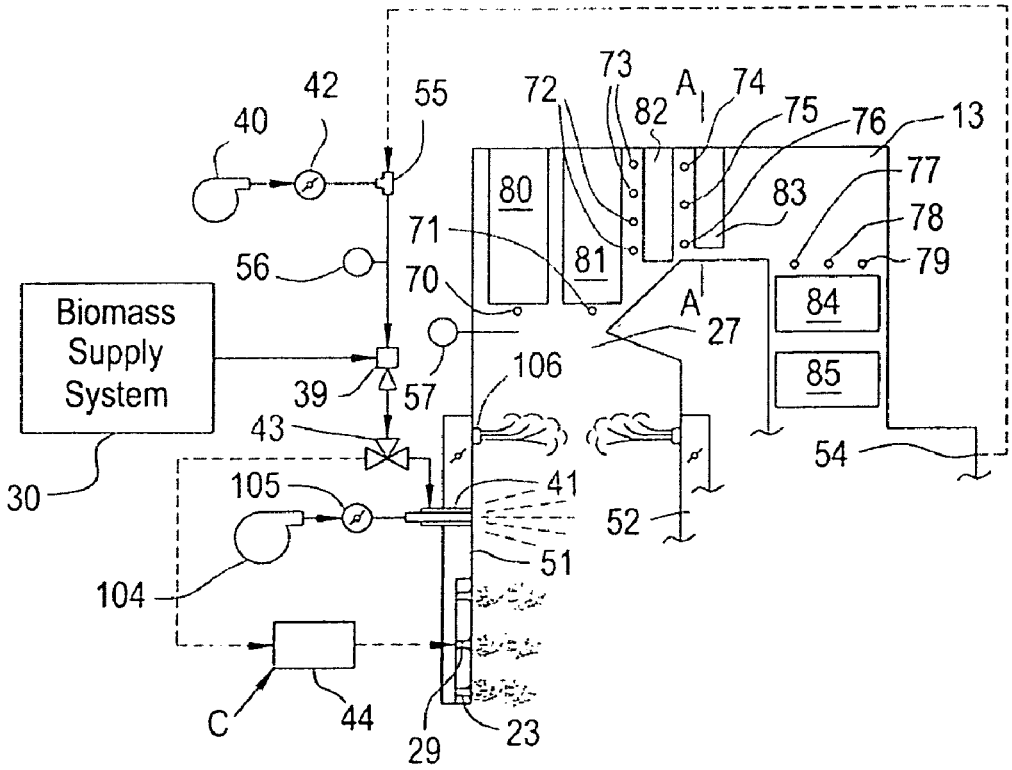
FIG. 5 is a schematic view of features of the boiler of FIG. 1.

The carrier gas may be ambient air that is supplied by a dedicated air fan, such as dedicated air fan 40 (see FIGS. 1 and 5), which is coupled to damper 42, air that is routed from the air manifolds 51 and 52, steam, recirculated flue gas (RFG), inert gas, or a mixture thereof, as long as the temperature and oxygen content of the carrier gas does not risk premature ignition of the biomass. With reference to FIG. 5, in an embodiment of the invention, a mixture of the RFG and ambient air may be used as the carrier gas. Here, the RFG is extracted from the exhaust path at point 54, located upstream from the air heater 53 (see FIG. 1), which is used to heat air entering air manifolds 51 and 52 and to cool exhaust gases proceeding to a downstream particulate collection device (PCD) 60. The RFG is then mixed with ambient air in mixer 55. This ambient air may be supplied by the dedicated air fan 40, which is provided in combination with the damper 42, as noted above. Thermocouple 56, which is disposed downstream from the mixer 55, may measure a temperature of the carrier gas as part of a feedback loop that is employed to control a temperature of the carrier gas. Additional RFG cleanup equipment such as cyclones or filters (not shown) can be used to reduce RFG particulate loading upstream from the mixer 55. Since a temperature of the RFG may be approximately 600 degrees Fahrenheit, with an ambient air to RFG mixing ratio of approximately 3:1, the biomass carrier gas temperature would be approximately 200 degrees Fahrenheit and safely below the biomass ignition temperature.

Utilization of the RFG as a carrier gas enables a preheating of and, at least, a partial pre-drying of the biomass. Pre-heated and pre-dried biomass fuel will read more readily when injected into the reburn zone 26. Also, utilization of the heat content of the RFG for fuel preheating may increase an overall efficiency of the furnace 20. Moreover, RFG extraction upstream from the air heater 53 reduces an overall exhaust gas flowrate through the PCD 60 and may increase particulate control efficiency.

In a further embodiment of the invention, where the thermocouple 56 is employed in the feedback loop to control a temperature of the carrier gas, a single control setpoint temperature can be chosen as a carrier gas temperature. Alternatively, a number of different setpoint temperatures can be chosen, with each setpoint matched to a specific biomass feedstock. That is, as a type of biomass used with the furnace 20 changes during the operation of the furnace 20, different setpoint temperatures of the carrier gas may be chosen.

In accordance with embodiments of the invention, since the reburn zone 26 of the furnace 20 is capable of operating with biomass, pulverized coal, or a mixture of flexible quantities of biomass and pulverized coal in accordance with a number of parameters such as boiler efficiency, pollutant emissions, steam production, etc., a number of problems associated with biomass fuel availability, variability, and reliability may be resolved.

For example, to achieve high levels of nitrogen oxide emissions reductions, large amounts of biomass may be required for the reburn fuel for the reburn zone 26 and may exceed 200,000 tons of biomass per year. The supply of such an amount of biomass depends upon seasonal availability and is subject to supply interruptions. Accordingly, in an embodiment of the invention a need for limited on-site storage of biomass is satisfied by, for example, a one-week supply of biomass.

In this case, when the biomass is available for use in the reburn fuel, the reburn fuel can comprise only biomass so as to reduce nitrogen oxide emissions in the reburn zone 26. When the supply of the biomass cannot be maintained, the reburn fuel can comprise a mixture of flexible quantities of biomass and coal. If the biomass supply is exhausted, the reburn fuel can comprise only coal. In addition, the flexible quantities of both of the biomass and the coal may be varied regardless of the amount of available biomass to alter boiler performance in accordance with changing furnace 20 conditions. For example, if the supplied biomass has a high moisture content, steam production in boiler 10 may decrease, leading to undesirable boiler derate. Here, negative impacts on the furnace 20 can be mitigated or avoided if a portion of the high-moisture biomass is substituted with coal.

To these ends, a control system (not shown) may be employed to adjust a ratio of biomass to coal in the reburn fuel mixture. For example, with reference to FIG. 4, an operational speed of a variable-speed feeder 38, which is included in the biomass supply system 30, can adjust a biomass flow rate into the eductor 39. As a result, the reburn fuel mixed in the eductor 39 will have a lower biomass concentration. Similarly, a coal flow rate is controllable by feeder 116, which is included in the coal feed system 110, and/or damper 103, which is coupled to the coal feed system 110. Again, the operational speed of the feeder 116 or the setting of the damper 103 can adjust an amount of coal supplied to the reburn injector 41. As a result, a concentration of coal in the reburn fuel can be adjusted.

The control system may also ensure that the reburn zone 26 of the furnace 20 is supplied with coal or biomass exclusively, for example, with the biomass feeding system 30 offline, the furnace 20 can continue to operate with only coal being used as the first fuel and the reburn fuel. Also, the control system may change the proportion of the biomass or coal in the reburn fuel in response to operational considerations based on feedback from a thermocouple 57 (see FIG. 4) located downstream from the burnout zone 27 in the outlet 12.

In addition, as shown in FIG. 5, a diverter 43, including a three-way valve, may allow for a diversion of all or a portion of the biomass/carrier gas mixture to a subset of burners 29 that includes at least one of the first and second burners 23 and 24. Such a diverter 43 would be disposed downstream from the mixer 55 and the eductor 39 and may provide for an additionally flexible operation of the furnace 20. That is, if a temporary interruption of reburn operations (for example, to perform maintenance or repair of the reburn injector 41) is desired while still utilizing a fuel including biomass to reduce emissions from the furnace 20, the biomass/carrier gas mixture may be supplied to the one or more of the main burners 23 and 24 and combusted in the main combustion zone 25.

In this case, the diverted biomass/carrier gas mixture, which is designated by the dotted line extending from the diverter 43 to the valve 44 and the subset of burners 29, can either be fired through the subset of burners 29 alone or in combination with the coal fuel. When the biomass/carrier gas mixture is to be fired alone, the coal fuel supply (designated by arrow, C) is cut off from the subset of burners 29 by the valve 44. When the coal and the biomass/carrier gas mixture are to be fired together, the subset of burners 29 may be required to comprise composite burners, such as concentric burners, in which coal is fed through a center pipe and biomass is fed through a concentric annular pipe. Alternatively, the coal and biomass/carrier gas mixture may also be pre-mixed upstream from subset of burners 29 or inside the subset of burners 29 themselves. Retrofitting the first and second burners 23 and 24 in a row-by-row sequence may be employed to prepare the subset of burners 29 for the diverted biomass/carrier gas mixture.

Figure 6:
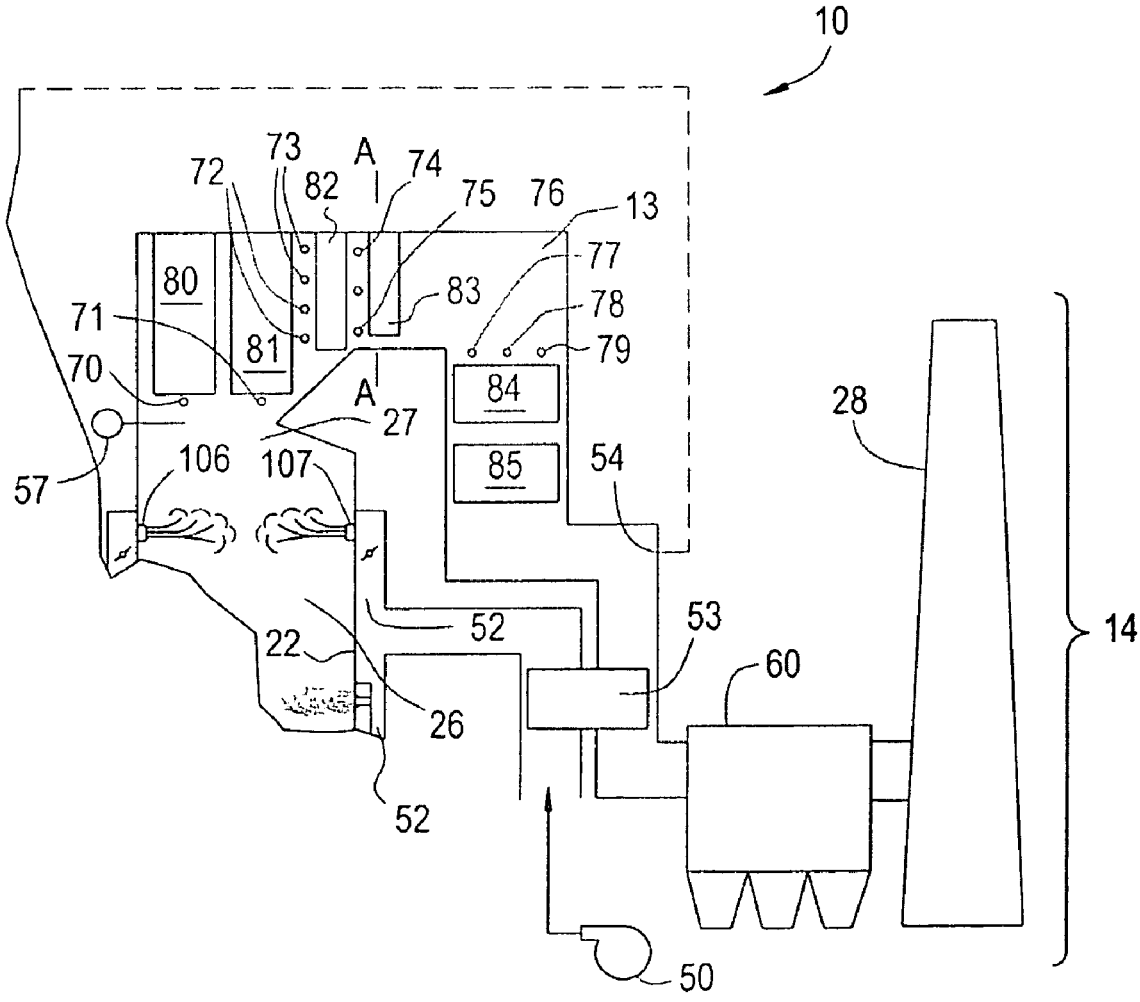
FIG. 6 is a schematic view of features of the boiler of FIG. 1.

With reference now to FIGS. 5 and 6, in embodiments of the invention, an increased mass flowrate of exhaust gas may occur as the exhaust gas travels through the exhaust path 13 and the exhaust system 14 due to the use of biomass as either a reburn fuel or a first fuel. In addition, reburn operations of the reburn zone 26 of the furnace 20 tend to change temperature distributions in the boiler 10, and can result in a changing temperature of the exhaust gas. Therefore, furnace 20 operations powered by biomass may negatively impact downstream boiler equipment such as the PCD 60.

According to an embodiment of the invention, the PCD 60 may comprise an electrostatic precipitator (ESP). Since biomass may have a lower ash content as compared to coals, it is expected that using biomass as a reburn fuel in the reburn zone 26 will reduce ash loading at an inlet of the PCD 60. However, since the use of biomass as a reburn fuel may lead to an increased exhaust gas flowrate, a reduced efficiency of particle collection may result. The exhaust gas temperature at an inlet of the PCD 60 may increase or decrease as a result of the furnace 20 operation. Here, PCD 60 (i.e., ESP) operating parameters, such as voltage, current density, rapping frequency, and so on, can be adjusted to account for the impacts caused by the furnace 20 operation. In particular, PCD 60 controls may be linked to the control system to integrate the furnace 20 and the PCD 60 operations.

Chemical and physical properties of the ash formed by combusting biomass differ significantly from those of the ash formed by combusting coal. Therefore, it is expected that a substitution of a portion of the coal fuel with biomass fuel will affect ash formation. That is, since the reburn fuel, including the biomass, is injected into the reburn zone 26 downstream from the main combustion zone 25, it is expected that biomass combustion will affect a formation of ash in the furnace 20. To this end, as shown in FIGS. 5 and 6, deposit control elements 70-79, which can include sootblowers, acoustic horns, pulsed detonation cleaners, etc, are typically located at deposit control locations in the vicinity of the heat transfer surfaces 80-85, such as superheater and reheater tube banks and platens.

The operation of the deposit control elements 70-79 may then be adjusted based on the type, amount, and chemical properties of the reburn fuel, since trajectories of coal particles differ from trajectories of biomass particles such that ash deposit characteristics and formation rates will exhibit non-uniform spatial distributions. For example, if it is expected that biomass ash particles will primarily concentrate in an upper part of cross section A-A, in the exhaust path 13 while coal ash particles will primarily concentrate in a bottom part of the cross section, different deposit removal frequencies may be employed for the deposit removal element 74 as compared to the deposit removal element 76 to achieve an optimum deposit control. A deposit removal frequency for each deposit removal element or subset thereof may be determined and controlled based on the characteristics of the main fuel (i.e., pulverized coal) and the reburn fuel (i.e., coal/biomass mixture) and operating conditions of the furnace 20.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A fuel flexible furnace, comprising:

a main combustion zone;

a reburn zone downstream from the main combustion zone; and a delivery system operably coupled to supplies of biomass and coal and configured to deliver the biomass and the coal as ingredients of first and reburn fuels to the main combustion zone and the reburn zone, with each fuel including flexible quantities of the biomass and/or the coal, wherein the flexible quantities variable with the furnace in an operating condition, wherein the delivery system comprises:

burners, to be supplied with the first and the reburn fuels, which are configured to fire into the main combustion zone;

at least one injector configured to inject the first and the reburn fuels into the reburn zone;

a coal feed system to provide pulverized coal as the supply of the coal for the first fuel and the reburn fuel; and a biomass supply system to provide a mixture of the supply of the biomass and a carrier gas for the first fuel and the reburn fuel, wherein the supply of the biomass comprises biomass particles having sizes in a range from approximately 0.2 mm to approximately 2 mm in size, and the biomass supply system comprises storage devices, a particle size reducing apparatus, and a mixer, in which the biomass particles are mixed with the carrier gas, wherein the carrier gas comprises ambient air, preheated combustion air diverted from the main combustion zone, recirculated flue gas (RFG), steam, inert gas, and/or a combination thereof, and further comprising a thermocouple to measure a carrier gas temperature, the measurement being employed to determine a mixing ratio of ingredients of the carrier gas.

2. The furnace according to claim 1, further comprising:

a burnout zone disposed within the furnace and downstream from the reburn zone; and a plurality of overfire air (OFA) injectors to inject OFA, including oxygen to mix with emissions from the reburn zone and the main combustion zone, into the burnout zone.

3. The furnace according to claim 1, further comprising a diverter disposed downstream from the biomass supply system to divert a portion of the mixture of the biomass and the carrier gas to the burners to be combusted in the main combustion zone.

4. The furnace according to claim 1, wherein the flexible quantities of the biomass and the coal in the reburn fuel comprise:

only biomass to reduce amounts of nitrogen oxides generated in the reburn zone, only coal when a supply of the biomass is exhausted or interrupted, and a combination of the biomass and the coal when a supply of the biomass is diminished and/or to allow for an adjustment of a performance of the furnace.

5. The furnace according to claim 2, further comprising:

an outlet of the furnace disposed downstream from the burnout zone;

an exhaust path coupled to the outlet, in which particulate matter, which is carried by the emissions from the main combustion zone and the reburn zone, is removed from heat transfer surfaces of the furnace; and an exhaust system, downstream from the exhaust path, through which the emissions are exhausted to an exterior of a boiler in which the furnace is installed.

6. The furnace according to claim 5, wherein the exhaust path comprises:

a plurality of deposit control elements to remove ash deposits from the heat transfer surfaces, wherein the deposit control elements are disposed in deposit control locations and operated in accordance with ash forming characteristics of the first fuel and the reburn fuel.

7. The furnace according to claim 5, wherein the exhaust system comprises:

an electrostatic precipitator to collect the particulate matter from the emissions; and an exhaust stack to exhaust the emissions to the exterior of the boiler.

8. The furnace according to claim 1, further comprising a combination of a booster air fan and flow control elements to increase a level of mixing of the ingredients of the reburn fuel prior to the injection thereof into the reburn zone by the at least one injector.

* * * * *